US005786836A

United States Patent [19]

Glennon, Jr.

[11] Patent Number: 5,786,836

[45] Date of Patent: Jul. 28, 1998

[54] USER CARD HAVING SELECTED VARIABLE DATA

[76] Inventor: Philip T. Glennon, Jr., 105 W. Shallowstone Rd., Greer, S.C. 29650

[21] Appl. No.: 626,277

[22] Filed: Apr. 4, 1996

[51] Int. Cl.[6] ..... B41J 3/20; B41M 5/20

[52] U.S. Cl. ..... 347/171; 347/221; 428/195; 503/227

[58] Field of Search ..... 347/171, 221; 283/81; 428/195, 913; 503/227

[56] References Cited

U.S. PATENT DOCUMENTS

| | | | |
|---|---|---|---|
| 4,746,932 | 5/1988 | Sato | 347/171 |
| 5,578,353 | 11/1996 | Drew, III | 428/195 |
| 5,599,765 | 2/1997 | Ohshima et al. | 503/227 |
| 5,658,647 | 8/1997 | Magill et al. | 428/913 |
| 5,681,660 | 10/1997 | Bull et al. | 428/195 |
| 5,712,222 | 1/1998 | Shirai et al. | 503/227 |

OTHER PUBLICATIONS

A bulletin for Print-A-Tag product, published 1994 by Identatronics, Inc., 425 Lively Blvd., Elk Grove Village, IL 60007 (with attached product specimen).

A bulletin for Print-A-Badge product, published 1992 by Identatronics, Inc., 425 Lively Blvd., Elk Grove Village, IL 60007 (with attached product specimen).

*Primary Examiner*—Stuart N. Hecker

*Attorney, Agent, or Firm*—Dority & Manning, P.A.

[57] ABSTRACT

An improved wallet card is provided having thereon selected variable data, such as unique bar code information. Due to the construction of the card, the variable data may be imprinted directly thereon in a substantially scratch-proof and smear-proof manner, using a standard thermal transfer printer. The construction thus eliminates the need to use separate bar code labels or lamination to protect the variable data. The card is preferably constructed having multiple layers, including a vinyl substrate layer and a polyester top layer. When the top layer is transparent, a preselected background pattern may be printed directly on the substrate layer. Preferably, the card will have an overall thickness of approximately eleven (11) mils.

21 Claims, 5 Drawing Sheets

USER CARD HAVING SELECTED VARIABLE DATA

BACKGROUND OF THE INVENTION

The present invention generally relates to card stock material which may be sold in rolls of indeterminate length. In particular, the invention relates to card stock material comprising a chain of interconnected cards which may be easily imprinted with selected variable data.

Wallet cards are often issued to individuals by various businesses and other organizations. For example, libraries often issue cards to their borrowers for use in checking out books. Similarly, club stores and often provide their customers with unique membership cards. Insurance companies frequently issue cards to their policyholders that can be used, for example, when submitting a claim.

In the past, bar code labels have often been applied to each such card at the time of issue. Prior to being applied to the card, the bar code labels are typically maintained on a paper carrier, which is generally wound into a roll. Other data, such as the name and address of the issuer, may be preprinted on the card and then overlaminated for protection.

Many prior art cards used in these applications have been similar to credit cards in construction. Such cards are typically made from stock having a thickness of approximately thirty (30) mils. As a result of this thickness, the cards tend to be relatively inflexible. The cards thus generally cannot be formed into a roll but must be precut at the factory and maintained by the issuer in a stack.

A need thus exists for a thin, but durable card that eliminates the requirement to use separate labels for unique bar code information. It would also be desirable to provide a card having selected variable data thereon without the need for lamination.

SUMMARY OF THE INVENTION

The present invention recognizes and addresses the foregoing disadvantages, and others, of prior art constructions and methods. Accordingly, it is an object of the present invention to provide an improved composite wallet card capable of receiving selected variable data.

It is another object of the present invention to provide a composite wallet card which receives selected variable data in a substantially scratch-proof and smear-proof manner, without the need for further lamination.

It is a more particular object of the present invention to provide such a card in which the variable data includes bar code information, thus eliminating the need to use separate bar code labels.

It is another object of the present invention to provide an improved wallet card which also carries a predetermined printed image which is protected by a transparent top layer.

It is a further object of the present invention to provide improved card stock for use with a standard thermal transfer printer device.

It is a further object of the present invention to provide a method of producing a card having selected variable data.

Some of these objects are achieved by a composite wallet card capable of receiving selected variable data utilizing a standard thermal transfer printer. In presently preferred embodiments, the card includes a substrate layer having a first predetermined thickness. A first planar face of the substrate layer may have a predetermined image printed thereon. A top layer having a second predetermined thickness is provided overlying the first planar face of the substrate layer. The top layer is preferably transparent such that the predetermined image on the substrate layer may be seen, but will be protected thereby. An adhesive layer having a third predetermined thickness is disposed between the substrate layer and the top layer. Furthermore, the top layer preferably has characteristic properties to permit receipt of the user-selected variable data in a substantially scratch-proof and smear-proof manner.

In exemplary embodiments, the top layer may be constructed of a specially treated polyester sheet material having a thickness of approximately two (2) mils. The substrate layer in such embodiments may be constructed of vinyl sheet material having a predetermined thickness of approximately eight (8) mils. In addition, the adhesive layer may have a thickness of approximately one (1) mil. As such, the total thickness of the composite wallet card in such embodiments may be approximately eleven (11) mils. A matte finish may also be disposed on a second planar face of the substrate to provide, for example, a surface for receipt of handwriting.

Other objects of the invention are provided by improved card stock for use with a thermal transfer printer. Preferably, the card stock comprises a chain of cards having an indeterminate length. The cards are interconnected and separated by respective perforation lines extending in a direction transverse to a longitudinal direction of the chain. Appropriate indentations, such as cusps, may be provided at respective opposite ends of the perforations lines to facilitate indexing in the printer. In presently preferred embodiments, the chain may be wound into a roll.

Each of the cards of the improved card stock may be constructed of a selected composite material. In presently preferred embodiments, the composite material may include a substrate layer of vinyl sheet material having a first predetermined thickness. A top layer of a polyester sheet material may also be provided having a second predetermined thickness. The second predetermined thickness is preferably less than approximately half the first predetermined thickness. An adhesive layer may also be provided between the substrate layer and the top layer. The adhesive layer may have a third predetermined thickness less than the second predetermined thickness.

In exemplary embodiments, the substrate layer is opaque and has a predetermined image printed on a front surface thereof. The top layer is preferably transparent in this case such that the predetermined image may be seen while being concurrently protected.

Other objects of the invention are achieved by a method of producing a card having thereon selected variable data. One step of the method involves providing a longitudinal chain of blank cards having indeterminate length. The cards are preferably constructed of a composite stock material including a substrate layer of a first sheet material, having a first predetermined thickness. In this case, a top layer of a second sheet material is also preferably provided, having a second predetermined thickness less than the first predetermined thickness. In addition, the top layer preferably has characteristic properties to permit receipt of the selected variable data from the printer in a substantially scratch-proof and smear-proof manner. An adhesive layer may also be provided between the substrate layer and the top layer, having a third predetermined thickness less than the second predetermined thickness.

An additional step of the method involves inserting the chain of blank cards into a standard thermal transfer printer. An endmost blank card is next indexed to a print location in the printer. Selected variable data may then be printed onto the endmost blank card. The endmost card, having the variable data thereon, is then advanced such that a subsequent blank card will be indexed to the print location. The endmost card having the selected variable data thereon may then be separated from the chain of blank cards, or the imprinted cards may be rerolled for later use as needed.

Other objects, features and aspects of the present invention will be recognized by those of ordinary skill in the art based on the discussion herein.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
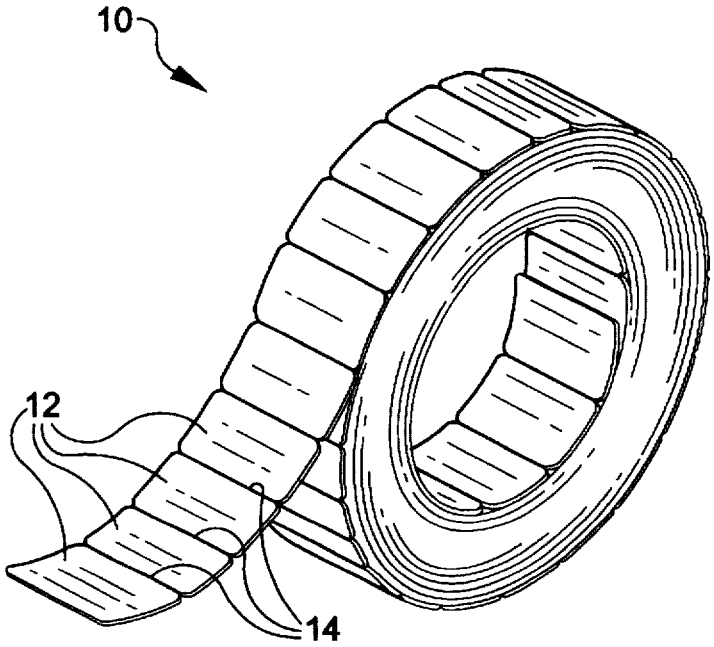
FIG. 1 is a perspective view illustrating a roll of improved blank cards constructed in accordance with the invention.

Repeat use of reference characters in the present specification and drawings is intended to represent same or analogous features or elements of the invention.

DETAILED DESCRIPTION OF THE PREFERRED EMBODIMENTS

It is to be understood by one of ordinary skill in the art that the discussion herein is a description of exemplary embodiments only, and is not intended as limiting the broader aspects of the present invention, which broader aspects are embodied in the exemplary constructions.

As noted above, a need exists for an improved card to which selected variable data may be easily applied, including unique bar code information, without the need for further lamination. A desirable card would be relatively thin and flexible and available in chain form, such as in rolls. The use of a standard thermal transfer printer device for producing the variable data is also very desirable. A standard thermal transfer printer is generally less expensive and more readily available, while concurrently having faster throughput, than many alternatives. Presently preferred embodiments of the invention disclosed herein achieve all of these desirable features.

Thus, referring now to FIG. 1, a roll 10 of improved card stock constructed in accordance with the present invention is illustrated. As can be seen, roll 10 includes a plurality of blank cards 12 interconnected and separated by respective transverse perforation, i.e. "perf," lines 14 to form a longitudinal chain of indeterminate length.

Figure 2:
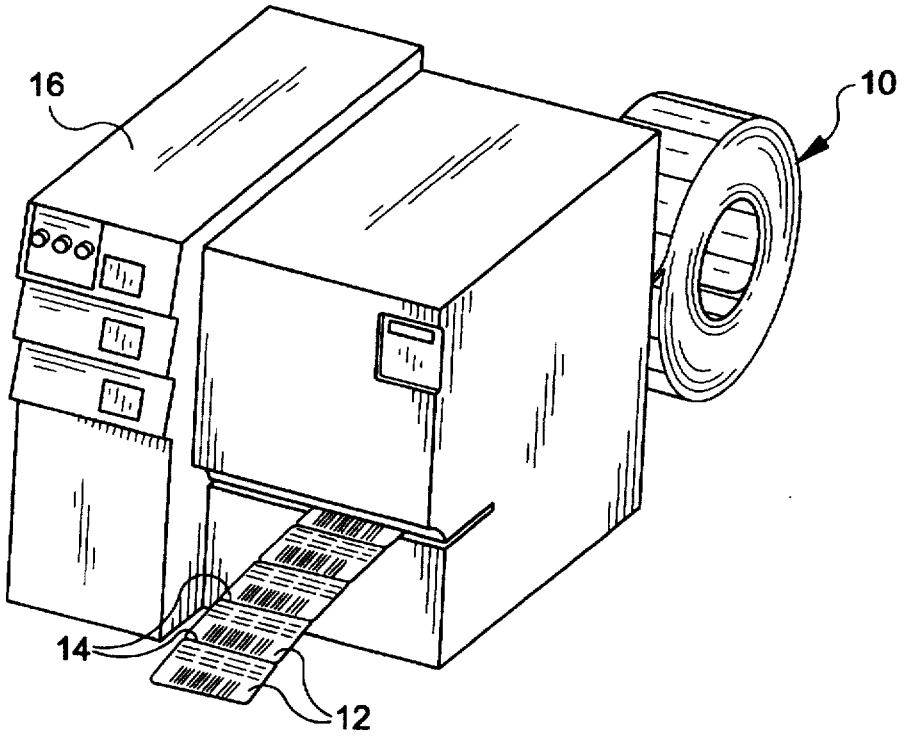
FIG. 2 is a perspective view illustrating use of the roll of FIG. 1 in a standard thermal transfer printer device.

FIG. 2 illustrates the use of roll 10 with a standard thermal transfer printer 16. Blank cards 12 are individually indexed through printer 16 to apply the selected variable data thereto. This variable data may include the name and address of the issuer, as well as unique bar code information.

In some applications, the endmost card may be easily removed along perf line 14 and provided directly to the cardholder. In other applications, the variable data will be applied by a service bureau, which then provides the imprinted cards to the issuer. In this latter case, the cards will typically be rerolled after the variable data has been applied.

Figure 2A:
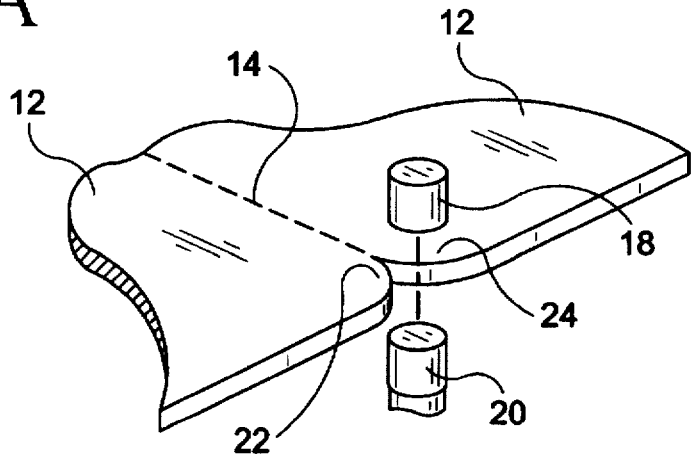
FIG. 2A is an enlarged view showing one manner in which successive cards may be indexed in the printer of FIG. 2.

FIG. 2A illustrates an enlarged view of the intersection of two blank cards 12. As can be seen, perf line 14 comprises a plurality of individual perforations that terminate at the rounded corners of the respective cards 12. While many perforation configurations may be utilized, perf line 14 preferably comprises microperforations. Such microperforations function to produce a relatively clean edge when the respective cards 12 are separated from one another. Preferably, a perforation density of approximately 72 perforations per inch is utilized for this purpose.

As can also be seen in FIG. 2A, many thermal transfer printers utilize light sensors to provide indexing of stock material therethrough. For example, a light source 18 may be placed at an appropriate location on one side (i.e., above or below) of the stock material. Similarly, a light detector 20 may be placed at a location on the other side of the stock material, aligned with light source 18. The combination of light source 18 and light detector 20 may thus detect indentations in the stock material, thereby indicating the location of successive units.

In this case, the indentations are preferably formed as cusps defined by opposed rounded corners 22 and 24 of adjacent cards 12. The radius of corners 22 and 24 is preferably chosen to provide a sufficient indentation for effective passage of the light beam. A radius of about 0.1875 inches or more has been found to be acceptable for this purpose.

Figure 3:
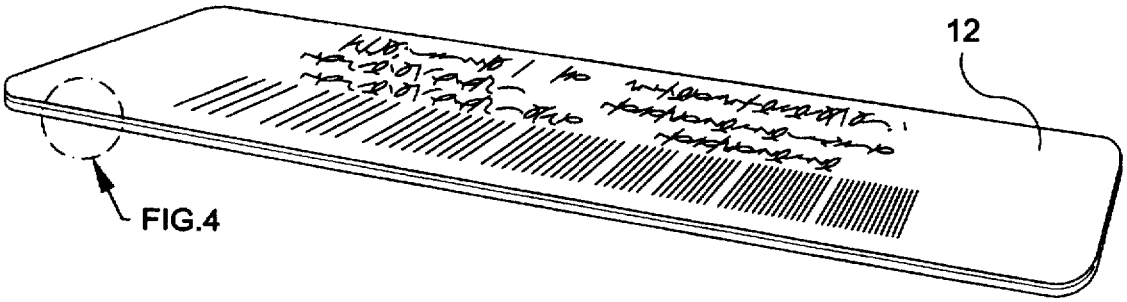
FIG. 3 is a perspective view of a single composite wallet card constructed in accordance with the present invention and having selected variable data applied thereto.
Figure 4:
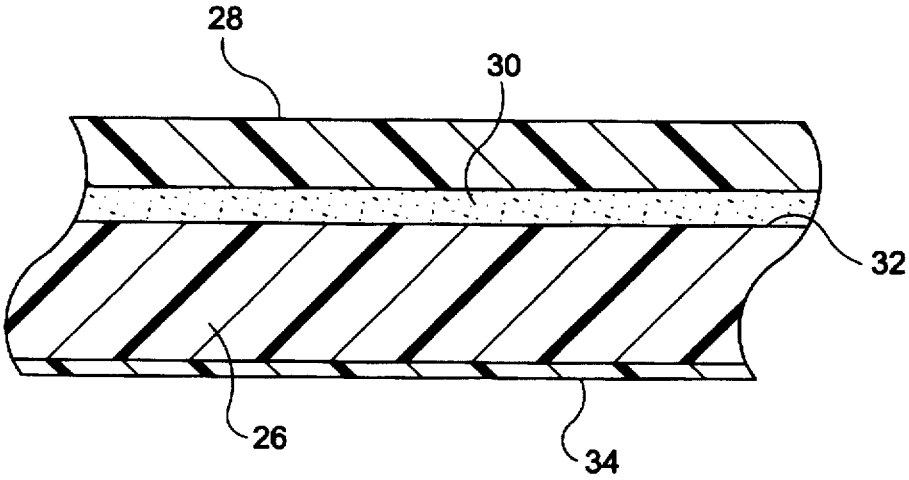
FIG. 4 is an enlarged cross-sectional view of the area so indicated in FIG. 3.

Referring now to FIGS. 3 and 4, cards 12 are preferably constructed of a novel composite sheet material which provides a desired combination of features. The material provides a card which is thin and flexible, while being less expensive than many other cards. Cards produced from the material may also be utilized with a standard thermal transfer printer. The cards also retain the variable data, including the unique bar code information, in a substantially scratch-proof and smear-proof manner, thus eliminating the need for bar code labels or protective lamination for the variable data.

As shown in FIG. 4, the composite material includes a substrate layer 26 having a top layer 28 disposed thereon. The substrate layer 26 and the top layer 28 are preferably maintained together by an intermediate adhesive layer 30.

Preferably, substrate layer 26 is constructed of a vinyl sheet material having a thickness falling within a range of approximately seven (7) to nine (9) mils, with approximately eight (8) mils being utilized in an exemplary embodiment. The top layer 28 may preferably be constructed of a polyester sheet material having a thickness falling within a range of approximately one (1) to three (3) mils, with approximately two (2) mils being utilized in an exemplary embodiment. The thickness of adhesive layer 30 may be approximately one (1) mil, thus resulting in an overall thickness of eleven (11) mils for the composite material. A thickness greater than eleven (11) mils may of course be used, but may exceed the tolerances of some standard thermal transfer printers.

As described above, it is contemplated that the selected variable data will generally be applied by a standard thermal transfer printer. As is well known, thermal transfer printers utilize a print head which contacts the surface to be printed through an intermediate ribbon carrying an appropriate resin. Frequently, the resin will have a tendency to smear, or easily scratch off, when applied to a relatively soft polymer. For example, thermally transferred resin will often scratch or smear when applied directly to a sheet of vinyl.

Polyester, however, is generally viewed as a relatively "hard" polymer material in the tag and label industry. Thus, sheet material of top layer 28 provides firm engagement between the surface and the print head. As a result, the resin is received in a substantially scratch-proof and smear-proof manner. The variable data on card 12 will therefore be, for all practical purposes, permanent. The need for further protective lamination, as has often been used in the past, can be eliminated.

The softer vinyl of substrate layer 26, however, produces a card which is more flexible than a card constructed of pure polyester. In addition to being easier to handle, this flexibility facilitates movement of the card chain through printer 16. Vinyl sheet material is also less expensive than polyester sheet of the same thickness. In addition, the lower overall hardness of the composite, in comparison with pure polyester, permits cards to be more cleanly die cut from the sheet material.

In presently preferred embodiments, top layer 28 and adhesive layer 30 are provided by a single, commercially available product. Specifically, a product known as THERMLfilm™, available from Flexcon Company, Inc. of Spencer, Mass., may be utilized for this purpose. For a two (2) mil thickness the relevant product number is OM-200-C T/C387 L-157 44PP8. For a one (1) mil thickness the relevant product number is OM-100-C T/C-387 L-157 44PP8. This product is sold in roll form in various thicknesses. A release liner is provided to expose the adhesive prior to use. This product is especially desirable in this application because it includes an ink-receiving topcoating.

Typically, substrate layer 26 may be opaque, while top layer 28 may be transparent. In this case, a predetermined printed image may be provided on the front surface 32 of substrate layer 26. Top layer 28 will thus protect the printed image on top surface 32, while allowing the image to be seen. As will be described below, a matte finish 34 may be disposed on the back face of substrate layer 26.

Figure 5:
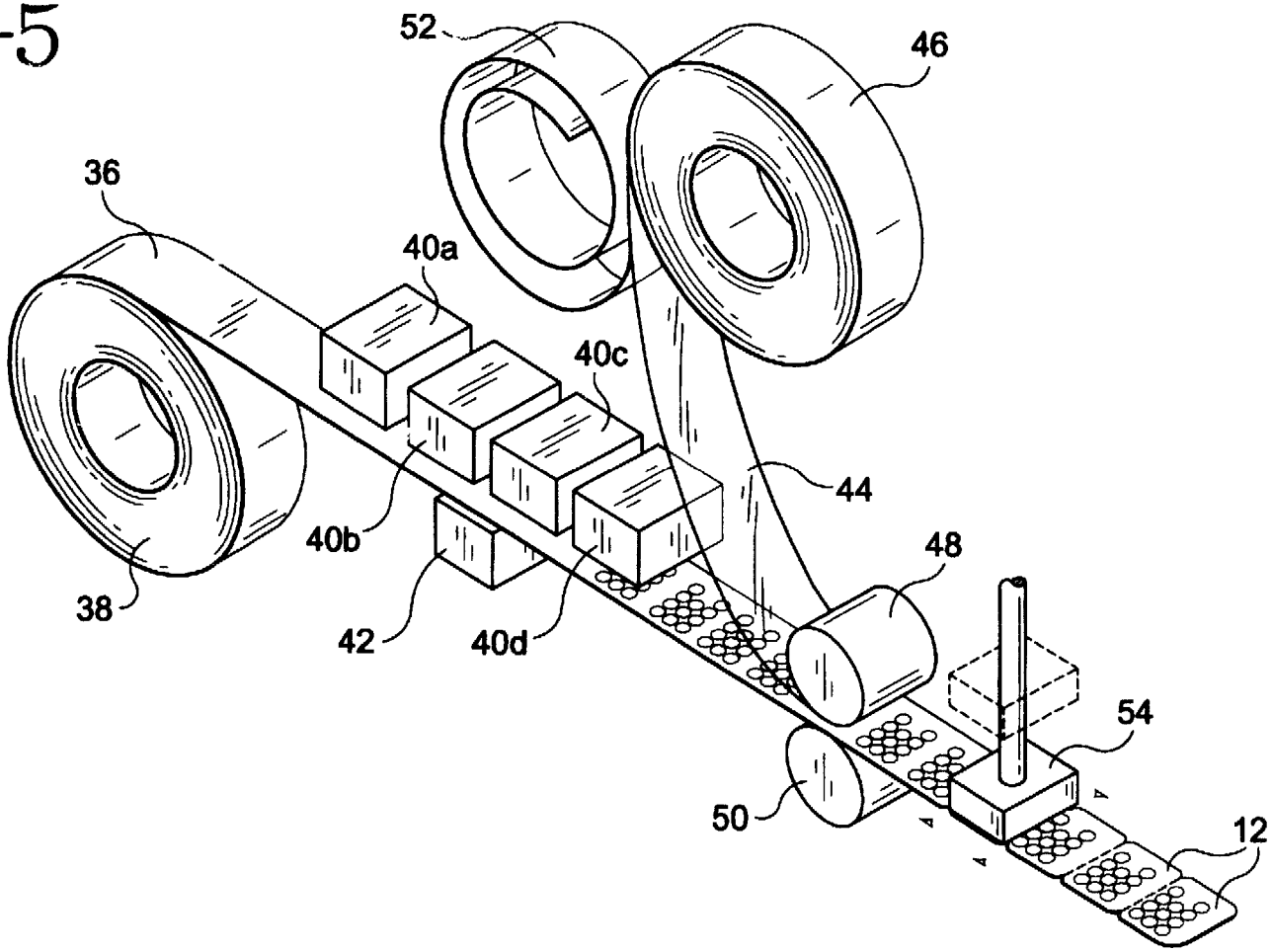
FIG. 5 is a diagrammatic representation illustrating one manner by which a chain of cards may be constructed in accordance with the present invention.

FIG. 5 illustrates a manner in which the chain of cards in accordance with the present invention may be produced. As shown, substrate material 36 is drawn in this case from a first roll 38. Substrate material 36 then passes between a series of upper print mechanisms 40*a*–40*d* and a lower print mechanism 42. Upper print mechanisms 40*a*–40*d* collectively produce the printed image applied to the top face of the substrate layer, with each print mechanism applying a respective color thereof. For example, 40*a* may correspond to red, 40*b* may correspond to blue, 40*c* may correspond to yellow and 40*d* may correspond to black. It should be appreciated, however, that any suitable combination of colors may be utilized. Print mechanism 42 functions to apply the matte surface to the back face of the substrate layer.

After the preprinted image has been applied to the substrate layer, top layer material 44, supplied from a roll 46, is merged thereon. Typically, this merger is facilitated utilizing a pair of opposed nip rollers 48 and 50. As described above, a preferred material for top layer material 44 also includes the adhesive utilized to maintain engagement with the substrate layer. In this case, the material will further include a suitable release liner 52. As shown, release liner 52 is typically removed as roll 46 is unwound.

After passing through nip rollers 48 and 50, the merged combination is subjected to die cutting to form the individual blank cards 12. The die creates the transverse perf lines across the card chain, as well as producing the rounded corners of the respective cards. In the illustrated embodiment, the die is shown as a reciprocative dye 54 which intermittently moves into and out of engagement with the card chain. It should be appreciated, however, that other suitable dies, such as rotary dies, may also be used.

Figure 6A:
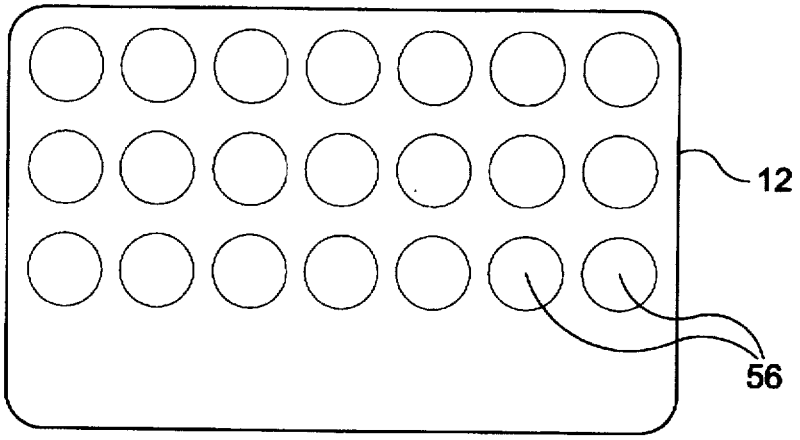
FIG. 6A is a view showing a predetermined printed image on a single blank card of the present invention.

FIG. 6A illustrates a representative blank card 12 produced by the process shown in FIG. 5. In this case, the printed image on the substrate material 36 comprises a series of multicolor circles, such as circles 56. Generally, the pattern will vary depending upon the activity in which the issuer is engaged. For example, if the issuer is a public library, the pattern may be an illustration of books as appearing on a bookshelf. For a "club store," the illustration may be a facsimile of the store logo.

Figure 6B:
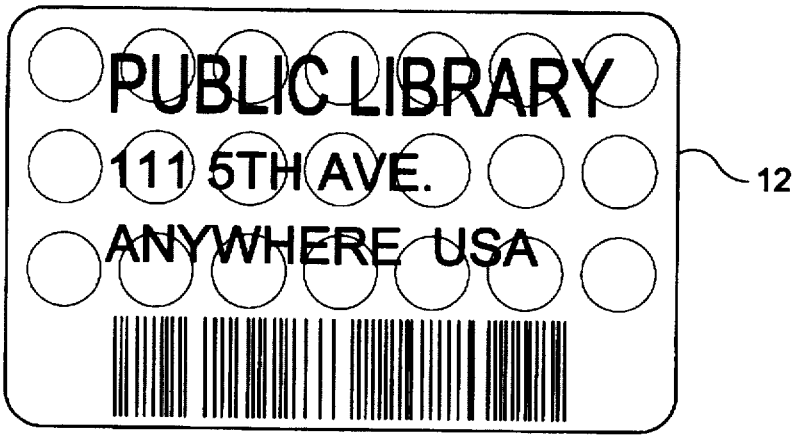
FIG. 6B is a view showing the single card of FIG. 6A further having selected variable data applied thereto.

FIG. 6B illustrates card 12 after having the variable data applied thereto. As can be seen, the variable data partially covers the printed image on the substrate layer. Thus, the printed image will serve as a "background" for the variable data.

Figure 6C:
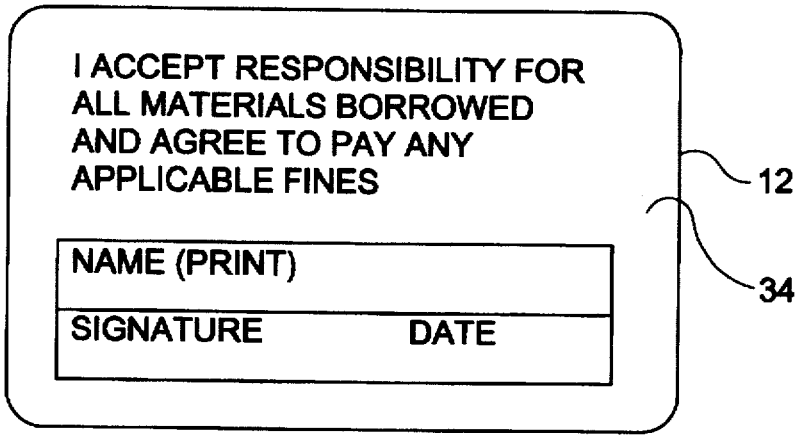
FIG. 6C is a view illustrating a back surface of the card of FIG. 6A.

FIG. 6C illustrates the back of card 12, showing the matte finish 34. Matte finish 34 is preferably of a type which suitably receives handwriting, such as an acknowledgment by the cardholder to agree to certain terms and conditions. Preferably, matte finish 34 covers the entire back surface of card 12.

While preferred embodiments of the invention, and preferred methods of practicing same, have been shown and described, various modifications may be practiced by those of ordinary skill in the art without departing from the spirit and scope of the present invention, as more particularly set forth in the appended claims. In addition, various embodiments of the invention may be interchanged both in whole or in part. Furthermore, one of ordinary skill in the art will appreciate that the foregoing description is by way of example only, and is not intended to be limitative of the invention.

What is claimed is:

1. A composite wallet card capable of receiving selected variable data utilizing a thermal transfer printer, said card comprising:

a substrate layer having a first predetermined thickness, a first planar face of said substrate layer having thereon a predetermined printed image;

a top layer having a second predetermined thickness, said top layer being transparent and overlying said first planar face of said substrate layer such that said predetermined printed image may be seen, but will be protected thereby;

said top layer further having characteristic properties to permit receipt of said selected variable data from said printer in a substantially scratch-proof and smear-proof manner; and an adhesive layer having a third predetermined thickness, said adhesive layer disposed between said substrate layer and said top layer.

2. A composite wallet card as set forth in claim 1, wherein said top layer is constructed of polyester sheet material.

3. A composite wallet card as set forth in claim 2, wherein said substrate layer is constructed of vinyl sheet material.

4. A composite wallet card as set forth in claim 3, wherein said first predetermined thickness is approximately eight (8) mils, said second predetermined thickness is approximately two (2) mils, and said third predetermined thickness is approximately one (1) mil.

5. A composite wallet card as set forth in claim 4, wherein said wallet card is arranged in a longitudinal string of similar cards interconnected and separated by transverse perforation lines, said longitudinal string having an indeterminate length.

6. A composite wallet card as set forth in claim 1, wherein a total thickness thereof is approximately eleven (11) mils.

7. A composite wallet card as set forth in claim 1, further comprising a matte finish disposed on a second planar face of said substrate.

8. A composite wallet card as set forth in claim 7, wherein said top layer has said selected variable data imprinted thereon.

9. Improved card stock for use with a printer device, said card stock comprising:

a chain of cards having an indeterminate length, said cards being interconnected and being separated by respective perforation lines extending in a direction transverse to a longitudinal direction of said chain;

each of said cards being constructed of a composite material, said composite material including:

(a) a substrate layer of a vinyl sheet material having a first predetermined thickness;

(b) a top layer of a polyester sheet material having a second predetermined thickness, said second predetermined thickness being less than approximately half said first predetermined thickness; and (c) an adhesive layer between said substrate layer and said top layer, said adhesive layer having a third predetermined thickness less than said second predetermined thickness.

10. Improved card stock as set forth in claim 9, wherein said substrate layer is opaque and has a predetermined image printed on a front surface thereof, said top layer being transparent such that said predetermined image may be seen while being concurrently protected.

11. Improved card stock as set forth in claim 10, wherein a back surface of said substrate layer opposite said front surface has a matte finish disposed thereon.

12. Improved card stock as set forth in claim 9, wherein said composite material has a total thickness of approximately eleven (11) mils.

13. Improved card stock as set forth in claim 12, wherein said first predetermined thickness is approximately eight (8) mils and said second predetermined thickness is approximately two (2) mils.

14. Improved card stock as set forth in claim 9, wherein said chain defines indentations at respective opposite ends of said perforation lines to facilitate indexing in said printer device.

15. Improved card stock as set forth in claim 14, wherein said chain is wound into a roll.

16. Improved card stock as set forth in claim 15, wherein each of said cards has selected variable data imprinted thereon including unique bar code information.

17. A method of producing cards having selected variable data, said method comprising the steps of:

(a) providing a longitudinal chain of blank cards having indeterminate length, said cards being constructed of a composite stock material, said stock material including:

(1) a substrate layer of a first sheet material having a first predetermined thickness;

(2) a top layer of a second sheet material having a second predetermined thickness, said second predetermined thickness being less than said first predetermined thickness, said top layer further having characteristic properties to permit receipt of said selected variable data in a substantially scratch-proof and smear-proof manner; and (3) an adhesive layer between said substrate layer and said top layer, said adhesive layer having a third predetermined thickness less than said second predetermined thickness;

(b) inserting said chain of blank cards into a thermal transfer printer device;

(c) indexing an endmost card to a print location in said thermal transfer printer device;

(d) printing selected variable data onto said endmost card; and (e) advancing said endmost card having said variable data thereon such that a subsequent blank card will be indexed to said print location.

18. A method of producing cards as set forth in claim 17, further comprising the step of (f) separating said endmost card having said selected variable data thereon from said chain of blank cards.

19. A method of producing cards as set forth in claim 17, further comprising the step of (f) rerolling said chain after said selected variable data has been imprinted onto respective cards thereof.

20. A method of producing cards as set forth in claim 17, wherein said top layer of said composite stock material is transparent and said substrate layer has a predetermined printed image thereon, said predetermined printed image being protected by said top layer.

21. A method of producing cards as set forth in claim 20, wherein said first sheet material is vinyl and said second sheet material includes polyester.

* * * * *